United States Patent [19]

Ohno et al.

[11] 4,058,232

[45] Nov. 15, 1977

[54] SAFETY CAP

[75] Inventors: Tetsuo Ohno; Shoji Watanabe, both of Tokyo, Japan

[73] Assignee: Iko Trading Co., Ltd., Tokyo, Japan

[21] Appl. No.: 736,828

[22] Filed: Oct. 29, 1976

[30] Foreign Application Priority Data

Mar. 9, 1976 Japan ..... 51-27100

[51] Int. Cl.[2] ..... B65D 55/02; B65D 85/56; A61J 1/00

[52] U.S. Cl. ..... 215/217; 215/223; 215/224

[58] Field of Search ..... 215/217, 223, 224

[56] References Cited

U.S. PATENT DOCUMENTS 3,690,496 9/1972 Gibson ..... 215/217

*Primary Examiner*—George T. Hall

*Attorney, Agent, or Firm*—Kane, Dalsimer, Kane, Sullivan and Kurucz

[57] ABSTRACT

A safety cap is adapted to assume a locked position on the neck of a container at which an annular cap rib rides within the concavity provided by an annular neck recess. In order to remove the cap, it must first be pulled outwardly to break this interengagement. Thereafter, the cap need only be rotated or turned to free the cap from neck threads. In order to mount the cap on the container neck, the cap is initially twisted to cause interengagement of the threads of the cap with the threads of the container neck. The threads are so arranged that when the cap rib engages the upper part of the neck recess, the last turn will force the rib into the recess and at the same time clear the threads from one another. In this position the cap will turn freely relative to the neck with the cap rib disposed within the neck recess.

2 Claims, 5 Drawing Figures

SAFETY CAP

BACKGROUND OF THE INVENTION

It has been recognized that many accidents and fatalities occur, particularly among children, through the accidental or unsuspecting use and/or consumption of drugs, poisons and many household products. As a result caps are in wide use today which are child-deterring by nature or require adult strength to open the container. Nonetheless, there remains a need for other effective and child resistant closures.

SUMMARY OF THE INVENTION

A principal object of the present invention is to provide a safety cap that is effective and comparable in price and cost to existing conventional screw cap closures and that is capable of providing a tight seal for a container which may be either plastic or glass having particular application as an enclosure for contact cement which may prove hazardous when not properly used.

DETAILED DESCRIPTION OF THE PREFERRED EMBODIMENT

Figure 1:
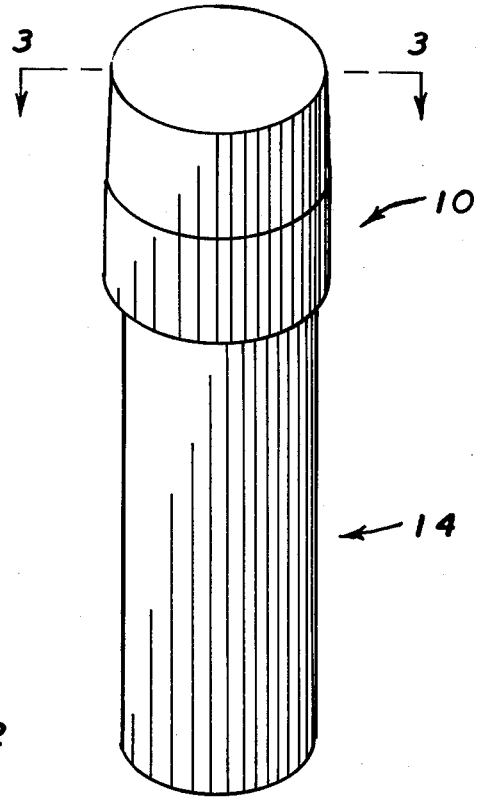
FIG. 1 is a top perspective view of a container bearing the safety cap of the present invention.
Figure 2:
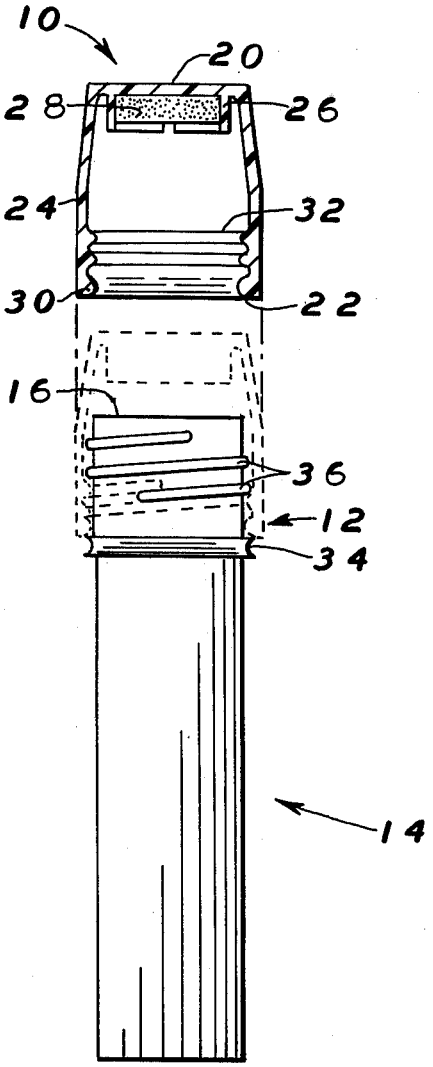
FIG. 2 is an exploded elevational view of a container and the safety cap with the latter being sectioned to disclose its interior construction.

In the drawings a cap 10 is adapted to couple with the neck 12 of the container 14. Both the container and neck may obviously assume any one of a variety of different configurations. In the illustrated embodiment, the neck 12 defines an opening or mouth 16 which provides access to the interior of the container and its contents which in the illustrated embodiment is a tube 18 of contact cement which if not properly used or handled may prove hazardous not only for children but adults as well.

Referring now to the cap 10, a closed upper end 20 and opened lower end 22 have interposed therebetween tubular side wall 24. Extending from the innerface of the closed end 20 is a cage 26 or similar structure for cooperating in retaining a sponge disc 28 for engaging with the top end of the closure of the tube 18 to eliminate undesirable motion of the tube 18 within the capped container 14. The lower end 22 of the cap 10 includes a circumferentially extending and radially inwardly projecting rib 30. Spaced a predetermined distance inwardly from the rib 30 is a predetermined length or extent of inwardly projecting teeth 32.

The exterior of the neck 12 is provided with cooperating surfaces for receiving the rib 30 and internal threads 32 of the cap 10 in securing the cap across the mouth 16 and permit its removal only after the child-deterrent position is encountered. In this connection, an annular neck recess 34 and a zone of external threads 36 appear on the container neck 12. The recess 34 is actually defined by a raised circumferentially extending strip having an outer concavity shaped to receive the rib 30 in a manner to be described shortly. In addition, the recess 34 is spaced from the external threads 36 by an amount at least equal to the length or extent of the internal threads 32 appearing on the cap as will become evident shortly.

In order to mount the cap 10, it is initially placed on the neck 12 of the container 14 and then turned or twisted to cause engagement of its internal threads 32 with the external threads 36 of the neck 12. The respective threaded zones are so arranged and located relative to the cap rib 30 and neck recess 34 that when the cap rib 30 engages the upper part of the neck recess 34, the last part of the turn of the engaged threads will force the rib 30 over the upper edge of the recess 34 into the concavity thereof. When this occurs the threads 32 of the cap 10 and threads 36 of the neck 12 will become disengaged and free from one another. The child-deterrent position will thus be attained with the cap being freely rotatable either clockwise or counter-clockwise without the threads engaging. Under the circumstances, the cap 10 may not be removed unless a prescribed procedure is followed.

Figure 3:
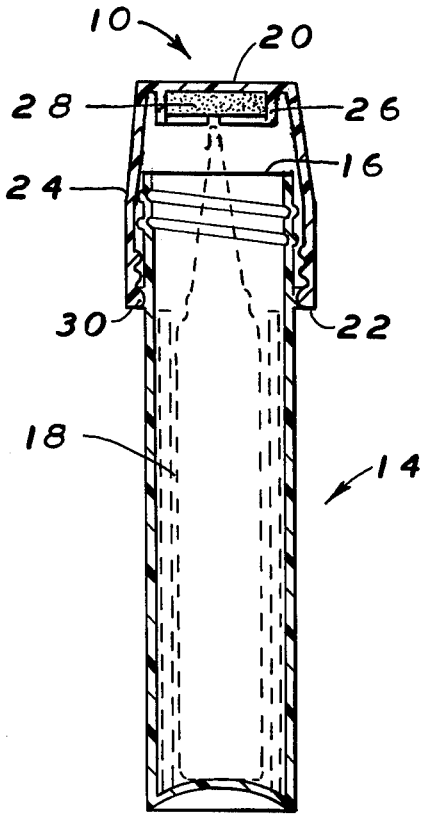
FIG. 3 is a similar side elevational view showing the cap mounted on the container while enclosing a tube of contact cement with parts of the container broken away, removed and sectioned.
Figure 4:
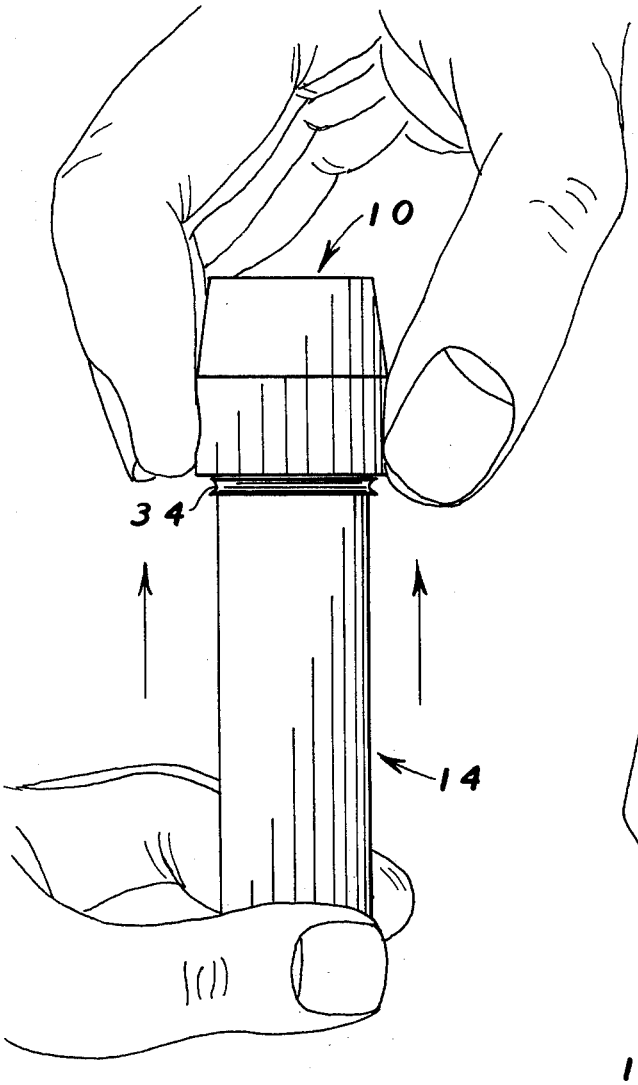
FIG. 4 is a side elevational view of the cap bearing container of FIG. 3 in the process of having the cap removed by initially pulling the cap in an axial direction.
Figure 5:
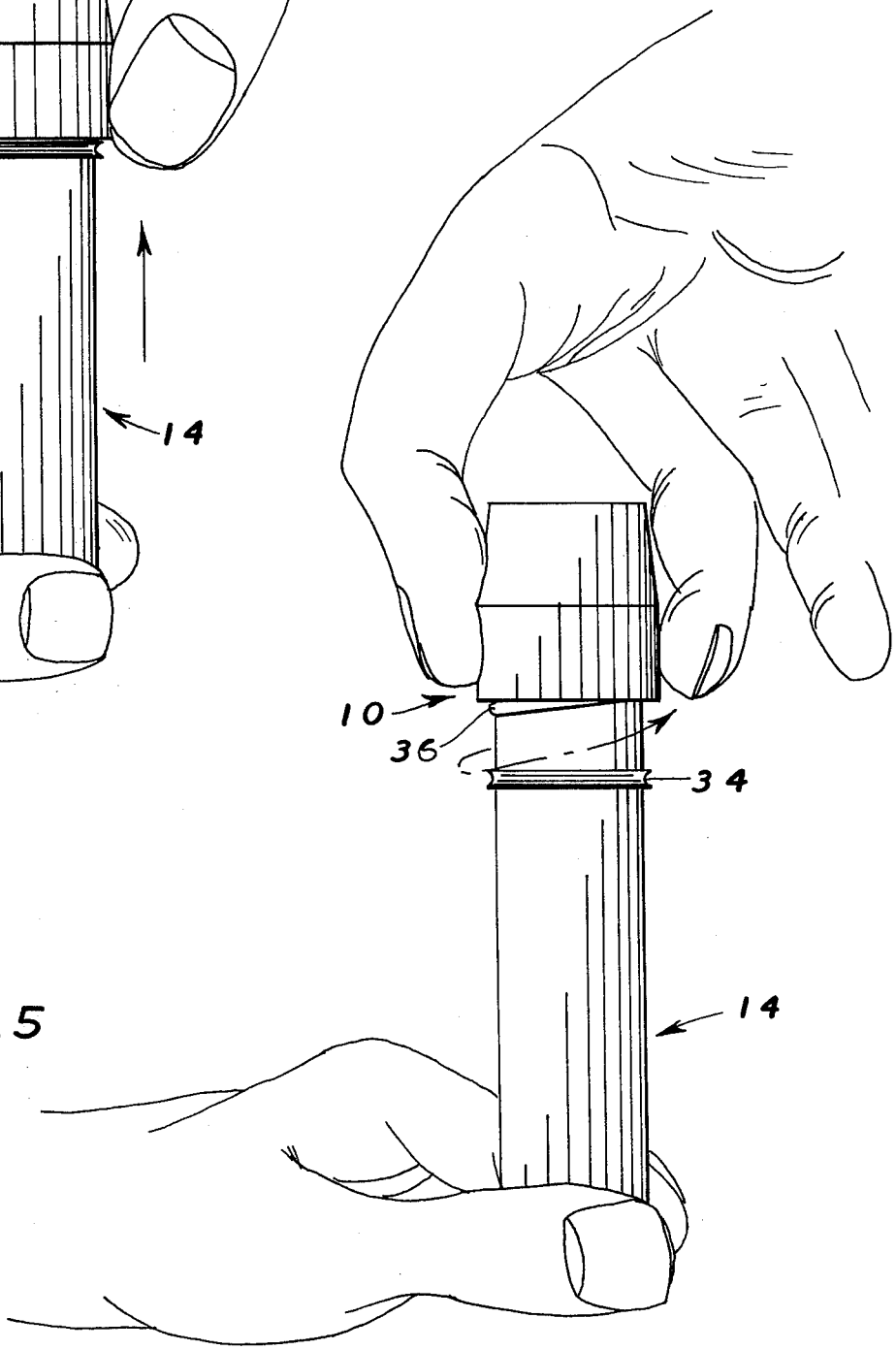
FIG. 5 is a similar side elevational view showing the next step involved in removing the cap which entails twisting or screwing the cap to eventually cause disengagement of mating threads of the cap and container neck.

In order to remove the cap 10 from the neck 12 of the container 14 from the child-deterrent position shown in FIG. 3, the cap 10 is initially retracted relative to the neck 12 in an axial direction as illustrated in FIG. 4. By pulling the cap 10 in this manner, the interengagement of the cap rib 30 and neck recess 34 is broken. With the cap rib 30 and neck recess 34 disengaged, the cap 10 may then be turned counter-clockwise as illustrated in FIG. 5 to initiate the interengagement of the cap threads 32 and neck threads 36. Thereafter the cap 10 need only be rotated or turned to free the cap threads 32 from the neck threads 36 to thereby obtain access to the interior of the container 14.

Thus the several aforenoted objects and advantages are most effectively attained. Although a single somewhat preferred embodiment of the invention has been disclosed in detail herein, it should be understood that this invention is in no sense limited thereby and its scope is to be determined by that of the appended claims.

What is claimed is:

1. A safety closure assembly comprising in combination:

the container neck defining an opening through which the container contents may be inserted and removed;

a closure cap coupled with the container neck and extending across the opening and cooperating in confining the contents within the container until it is desired to remove same therefrom, the cap including an upper closed end and a lower open end;

the exterior of the neck and the interior of the cap having cooperating interengaging means for coupling the cap to the neck in relatively easy fashion and permit the uncoupling of the cap from the neck only upon informed deliberate manipulation of the cap relative to the neck, said cooperating interengaging means comprising a zone of mating threads on the interior of the cap and exterior of the neck, said cooperating means further including rib means and recess means at a predetermined location relative to the threaded zones and adapted to engage with one another to assume a child-deterrent position at which the cap threads and neck threads are disengaged and the cap may be turned relative to the neck in either direction without permitting the threads to become engaged to permit withdrawal of the cap from the neck, the rib means being on the interior of the cap and being in the form of an annular inwardly extending rib located at the open end of the cap, the recess means being on the exterior of the neck and being defined by a concavity in a circumferentially extending raised strip, the strip being located at a predetermined distance below the threaded zone on the container neck so that when the rib is disposed in the recess the cap threads are disengaged from the neck threads with the cap threads being disposed in the space between the neck threads and the strip, the cap being permitted to be withdrawn from the neck by initially retracting and pulling the cap in an axial direction relative to the neck to cause disengagement of the rib means and recess means and thereafter twisting the cap relative to the neck to permit the cap threads and neck threads to become engaged whereupon further twisting of the cap relative to the neck will permit removal of the cap.

2. The invention in accordance with claim 1, wherein the rib is at a predetermined location relative to the cap threads so that when the cap is to be mounted on the container neck and turned to the child-deterrent position, the threads on the cap and neck will be engaged and about to be disengaged when the cap rib engages the upper part of the strip defining the neck recess whereupon the last part of the turn while the threads are engaged will force the rib into the recess following which the threads will become disengaged.

* * * * *